US005109640A

United States Patent [19]

Creson

[11] Patent Number: 5,109,640

[45] Date of Patent: May 5, 1992

[54] SCREEN FOR A RAIN GUTTER

[76] Inventor: Ronald Creson, 11490 Maxfield Blvd., Hartland, Mich. 48353

[21] Appl. No.: 670,894

[22] Filed: Mar. 18, 1991

[51] Int. Cl.[5] ..... E04D 13/00

[52] U.S. Cl. ..... 52/12; 52/14; 210/474; 210/477

[58] Field of Search ..... 52/11, 12, 15, 16, 13, 52/14; 210/163, 164, 474, 477, 499

[56] References Cited

U.S. PATENT DOCUMENTS

| | | | |
|---|---|---|---|
| 2,209,741 | 7/1940 | Sullivan et al. | 52/11 |
| 2,526,271 | 3/1948 | Probst | 52/11 |
| 4,592,174 | 6/1986 | Hileman | 52/12 |
| 4,907,381 | 3/1990 | Ealer | 52/12 |
| 4,937,986 | 7/1990 | Way, Sr. et al. | 52/12 |

*Primary Examiner*—David A. Scherbel
*Assistant Examiner*—Robert Canfield
*Attorney, Agent, or Firm*—Gifford, Groh, Sprinkle, Patmore and Anderson

[57] ABSTRACT

A device is disclosed which prevents the accumulation of leaves and other debris in a rain gutter on a building. The rain gutter is conventional in construction and is elongated having an open top formed by two spaced apart and parallel upper edges. The outer upper edge of the gutter includes a lip. The device includes an elongated screen having a pair of spaced apart edges. One edge is designed to engage the outer rain gutter lip so that, with the other edge of the screen in engagement with the building facia board, the screen is compressively retained to the rain gutter so that the screen overlies and covers the open top of the rain gutter. In order to facilitate the attachment and detachment of the screen with respect to the rain gutter, an elongated V-shaped depression is formed longitudinally along the screen. This V-shaped depression forms facing wall sections of the screen which, when compressed together, retract one or both of the screen edges from the rain gutter thereby facilitating both attachment and detachment of the screen.

4 Claims, 1 Drawing Sheet

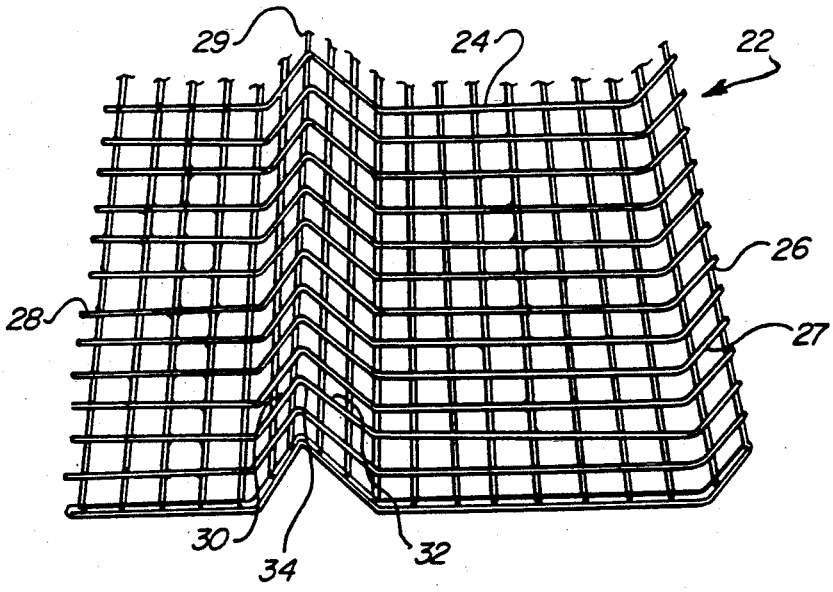
Fig-1
Fig-2
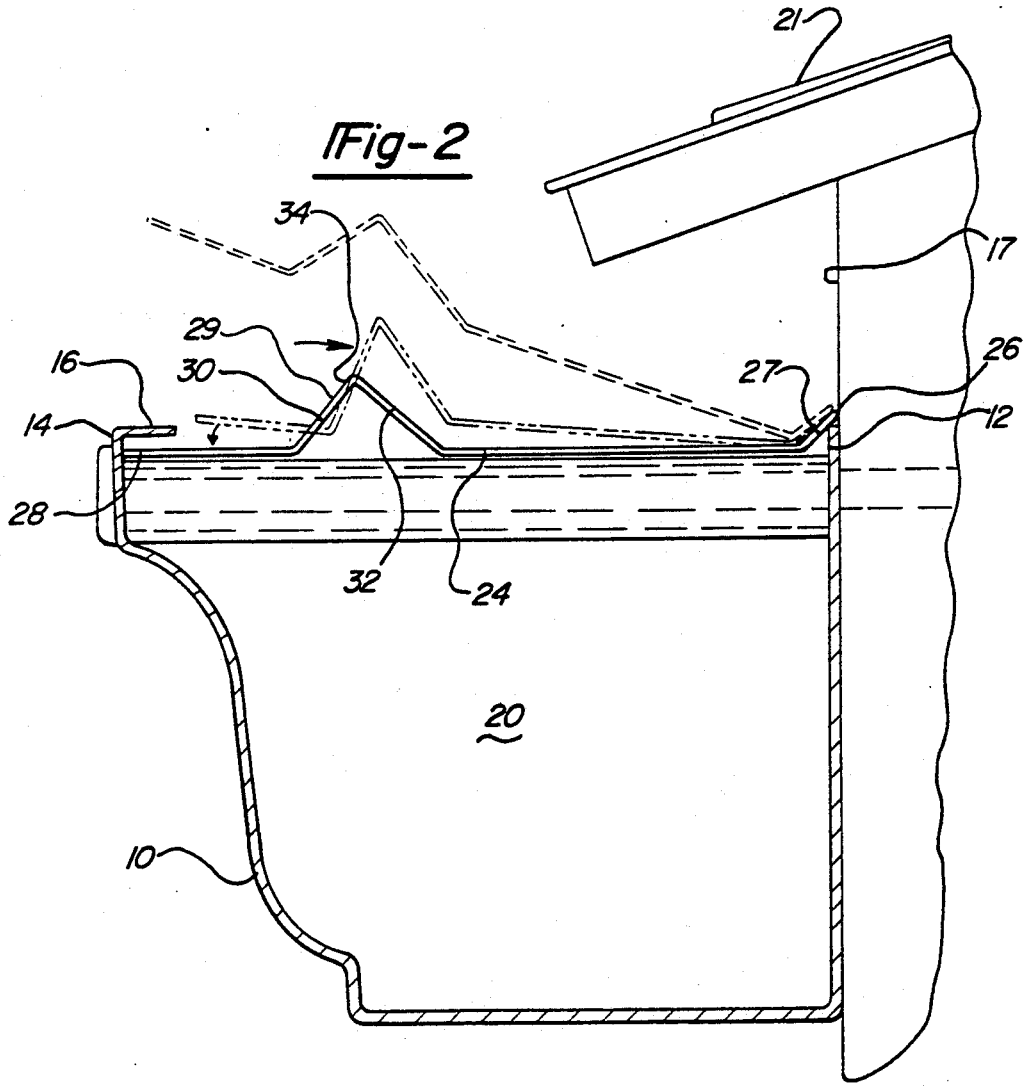

SCREEN FOR A RAIN GUTTER

BACKGROUND OF THE INVENTION

I. Field of the Invention

The present invention relates generally to a screen for a rain gutter to prevent the accumulation of leaves and other debris within the rain gutter.

II. Description of the Prior Art

In both commercial and residential building constructions, a rain gutter or eaves trough is typically provided around the roof's eaves. The rain gutter receives rain water falling from the roof and discharges this rain water through appropriate down spouts in an orderly and managed fashion.

One common problem with rain gutters is that leaves and other debris oftentimes collect and accumulate within the gutter. These leaves and other debris clog not only the rain gutter, but also the down spout. Such blockage not only renders the rain gutter system ineffective but can also damage the rain gutter, roof and the building eaves in the event that water trapped within the rain gutters by the debris freezes.

In order to prevent the accumulation of leaves and other debris in the rain gutters, there have been a number of previously known screens which are disposed across the open top of the rain gutters. These screens thus allow rain water to pass through the screen into the gutter in the desired fashion. At the same time, however, the screens prevent leaves and other debris from entering into the interior of the rain gutter.

One difficulty with these previously known screens, however, is that they are relatively difficult to install over the rain gutter. Furthermore, these screens, once installed over the rain gutters are difficult to remove in the event that maintenance of the rain gutter and/or screen is necessary.

SUMMARY OF THE PRESENT INVENTION

The present invention provides a device which overcomes all of the above mentioned disadvantages of the previously known devices.

In brief, the device of the present invention comprises an elongated screen having two spaced apart edges. One edge is adapted to engage a lip along one top outer edge of the rain gutter and, similarly, the other or inner edge of the screen is adapted to engage the building facia board. Furthermore, the screen is dimensioned so that, with the screen positioned across the open top of the rain gutter, the rain gutter compressively holds and retains the screen against the facia board.

In order to facilitate both the installation of the screen and its removal from the rain gutter when desired, an elongated depression is formed longitudinally along the length of the screen. This depression forms two facing wall sections of the screen which are generally V-shaped in cross sectional shape although other shapes can also be used.

Compression of the wall sections towards each other thus retracts the edges of the screen from the rain gutter and/or the facia board. Such retraction effectively reduces the width of the screen to facilitate both its installation into and removal from the rain gutter. Furthermore, due to the resilient nature of the screen, upon release of the wall sections, the screen expands to its original shape thus resiliently and compressively retaining the screen to the rain gutter.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which:

FIG. 1 elevational view illustrating a preferred embodiment of the present invention; and FIG. 2 is a diagrammatic view illustrating the operation of the device of the present invention.

DETAILED DESCRIPTION OF A PREFERRED EMBODIMENT OF THE PRESENT INVENTION

With reference first to FIG. 2, a rain gutter 10 is thereshown which is generally U-shaped in cross sectional shape. As such, the rain gutter includes both an inner and outer edge 12 and 14, respectively, which are spaced apart and generally parallel with respect to each other. Additionally, in the conventional fashion, a lip 16 is formed along the outer upper edge 14.

The rain gutter 10 may be constructed of any of a variety of different materials, such as plastic or metal, and is attached to a building facia board 17 below the edge of a building roof 21. As is well known, rain water falling from the building roof 21 enters the interior 20 of the rain gutter 10. The rain gutter 10 then channels the collected rain water to down spouts (not shown) where the rain water is ultimately discharged in an orderly fashion.

With reference now to FIG. 1, the present invention provides a device 22 for preventing the entry and accumulation of leaves and other debris within the interior 20 of the rain gutter 10. As best shown in FIG. 1, the device 22 of the present invention comprises an elongated screen 24 having two spaced apart and parallel edges 26 and 28. The screen 24 is constructed from criss-crossing metal wires which resiliently maintain the overall shape of the screen 24.

As best shown in FIG. 2, the screen 24 is dimensioned so that, with the screen edge 28 positioned in engagement with the lip 16 of the rain gutter 10 and the opposite edge 26 of the screen 24 positioned in engagement with the building facia board 17, the screen 24 is compressively held to the rain gutter 10 so that the screen 24 overlies the open top of the rain gutter 10. Furthermore, a turned up portion 27 of the screen 24 along its inner edge 26 ensures a firm engagement with the building facia board 17. (Alternatively, the portion 27 can be turned down.) Thus, with the screen 24 positioned across the open top of the rain gutter 10 as shown in solid line in FIG. 2, the screen 24 effectively prevents the entry and accumulation of leaves and other debris within the interior 20 of the rain gutter 10. At the same time, the openings in the screen 24 permit rain water to pass through the screen 24 and into the interior 20 of the rain gutter 10 in the desired fashion.

With reference now to FIGS. 1 and 2, a longitudinally extending depression 29 is formed along the screen 24 at a midpoint between the edges 26 and 28. This depression 29 is preferably V-shaped in cross sectional shape thus forming two wall sections 30 and 32 which have a common upper edge 34 and generally face each other. Furthermore, these wall sections 30 and 32 lie in a plane that is oblique with respect to the remainder of the screen 24.

Although the depression is preferably V-shaped in cross section, other shapes may alternatively be used.

Similarly, although only a single depression 29 is shown in the drawing, plural depressions 29 can also be used.

The longitudinally extending depression 29 forming the facing wall sections 30 and 32 of the screen 24 facilitates both the installation of the screen 24 across the top of the rain gutter 10, as well as the removal of the screen 24 from the rain gutter 10 when desired. More specifically, as best shown in FIG. 2, compression of the wall sections 30 and 32 together as shown in phantom line effectively draws the edges 26 and 28 towards each other and reduces the lateral width of the screen 24. In doing so, the outer edge 38 is retracted and disengages from its associated lip 16 of the rain gutter. Once the edge 28 is retracted from its lip 16, the screen 24 can be easily positioned within the rain gutter 10 or removed from it.

Once the screen 24 is positioned as desired so that it overlies the top of the rain gutter, the facing wall sections 30 and 32 of the screen 24 are released. Upon release, the screen, due to its resilient nature, resumes its original shape so that the edges 26 and 28 are compressively retained in their lip 16 and against the building facia board 17, respectively. Subsequent removal of the screen 24 from the rain gutter 10 can be accomplished by again squeezing the facing wall sections 30 and 32 towards each other so that the outer edge 28 is retracted and disengages from its lip 16. Once disengaged, the entire screen 24 can be easily removed from the rain gutter 10.

Although the inner edge 26 of the screen 24 preferably engages the building wall 17, it can alternatively engage the inner upper edge 12 of the gutter 10.

From the foregoing, it can be seen that the present invention provides a simple and yet totally effective device for preventing the entry and accumulation of leaves and other debris wtihin the rain gutter of a rain gutter system. Furthermore, the installation of the screen onto the rain gutter, or its removal from the rain gutter, can be simply and rapidly accomplished.

Having described my invention, however many modifications thereto will become apparent to those skilled in the art to which it pertains without deviation from the spirit of the invention as defined by the scope of the appended claims.

I claim:

1. For use in conjunction with an elongated rain gutter of the type having two spaced apart and generally parallel upper edges which form an open top of the rain gutter, and a lip extending along an upper outer edge and an inner edge attached to a building facia board, a device to prevent the entry of debris into the rain gutter comprising:

an elongated screen having spaced apart and parallel inner and outer edges, said screen being dimensioned so that, with said outer screen edge in engagement with said upper outer edge under said lip and said inner edge having a turned-up portion in engagement with the building facia board, said screen covers the open top of the rain gutter and is compressively retained between the rain gutter outer lip and the building facia board, means for facilitating attachment and detachment of said screen with the rain gutter comprising two facing wall sections formed in said screen, said wall sections having a common edge which is substantially parallel to and positioned in between said edges, a first planar screen portion extending on a generally horizontal plane between said outer screen edge and said means for attachment, a second planar screen portion extending on said generally horizontal plane between said turned-up portion of said inner edge and said means for attachment, said horizontal plane extending below said lip wherein said facing wall sections each lie in a plane oblique to said horizontal plane of said first and second planar screen portions wherein compression of said wall sections toward each other retracts and disengages at least one of said screen edges from its associated lip or building facia board to thereby allow attachment and detachment of said screen with respect to said rain gutter.

2. The invention as defined in claim 1 wherein said wall sections taken together present a generally V-shaped cross sectional shape.

3. The invention as defined in claim 1 wherein said common edge is substantially midway between said screen edges.

4. The invention as defined in claim 1 wherein said screen is formed from criss-crossing metal wires.

* * * * *